US009816386B2

(12) United States Patent
Feldmann et al.

(10) Patent No.: US 9,816,386 B2
(45) Date of Patent: Nov. 14, 2017

(54) CASING ARRANGEMENT FOR A GAS TURBINE

(71) Applicant: MTU Aero Engines AG, Munich (DE)

(72) Inventors: Manfred Feldmann, Eichenau (DE); Franz-Josef Ertl, Munich (DE)

(73) Assignee: MTU AERO ENGINES AG, Munich (DE)

( * ) Notice: Subject to any disclaimer, the term of this patent is extended or adjusted under 35 U.S.C. 154(b) by 431 days.

(21) Appl. No.: 14/703,503

(22) Filed: May 4, 2015

(65) Prior Publication Data

US 2015/0330237 A1 Nov. 19, 2015

(30) Foreign Application Priority Data

May 14, 2014 (DE) ..... 10 2014 209 057

(51) Int. Cl.

| | |
|---|---|
| ***F01D 11/14*** | (2006.01) |
| ***F01D 9/04*** | (2006.01) |
| ***F01D 11/18*** | (2006.01) |
| ***F01D 25/24*** | (2006.01) |
| *F01D 11/08* | (2006.01) |

(52) U.S. Cl.

CPC ..... *F01D 9/042* (2013.01); *F01D 11/18* (2013.01); *F01D 25/246* (2013.01); *F01D 11/08* (2013.01); *F05D 2240/11* (2013.01)

(58) Field of Classification Search

CPC ..... F01D 9/042; F01D 25/246; F01D 11/18; F01D 11/08; F01D 11/14; F01D 11/12; F01D 25/26; F05D 2240/11

See application file for complete search history.

(56) References Cited

U.S. PATENT DOCUMENTS

| | | | | |
|---|---|---|---|---|
| 5,839,878 | A | 11/1998 | Maier | |
| 6,126,390 | A * | 10/2000 | Bock | F01D 11/18 415/115 |
| 8,133,018 | B2 * | 3/2012 | Dakowski | F01D 9/042 415/209.2 |
| 8,147,192 | B2 * | 4/2012 | Jones | F01D 11/24 415/173.1 |
| 9,222,363 | B2 * | 12/2015 | Cloarec | F01D 5/26 |
| 2007/0122270 | A1 | 5/2007 | Brueckner et al. | |

(Continued)

FOREIGN PATENT DOCUMENTS

| | | |
|---|---|---|
| DE | 103 12 956 A1 | 9/2004 |
| EP | 0937864 A2 | 8/1999 |

(Continued)

*Primary Examiner* — Gregory Anderson
*Assistant Examiner* — Eldon Brockman
(74) *Attorney, Agent, or Firm* — Barlow, Josephs & Holmes, Ltd.

(57) ABSTRACT

The present invention relates to a gas turbine casing arrangement having a gas turbine casing element (10), a guide-vane ring with an outer ring (20), and a coated ring (30), which lies radially opposite a rotor grid (40) adjacent to the guide-vane ring, whereby an intermediate ring (50) by a downstream front face (51) engages behind an upstream stop (61; 61') fixed in place on the casing element, and by an upstream front face (52) of a radial flange (53) of the intermediate ring engages behind a downstream stop (22) fixed in place on the outer ring, in order to secure the guide-vane ring axially at the gas turbine casing element in the direction of through-flow.

14 Claims, 3 Drawing Sheets

(56) References Cited

U.S. PATENT DOCUMENTS

| | | | | |
|---|---|---|---|---|
| 2008/0267768 | A1* | 10/2008 | Dakowski | F01D 25/246 415/115 |
| 2010/0074745 | A1* | 3/2010 | Jones | F01D 11/24 415/209.3 |
| 2013/0202423 | A1* | 8/2013 | Cloarec | F01D 5/26 415/191 |

FOREIGN PATENT DOCUMENTS

| | | | |
|---|---|---|---|
| FR | 2646221 | A1 | 10/1990 |
| FR | 2957115 | A1 | 9/2011 |
| GB | 2485016 | A | 5/2012 |
| WO | 2013156734 | A1 | 10/2013 |

* cited by examiner

CASING ARRANGEMENT FOR A GAS TURBINE

BACKGROUND OF THE INVENTION

The present invention relates to a casing arrangement for a gas turbine having a gas turbine casing element and a guide-vane ring; a gas turbine, in particular a gas turbine for an aircraft engine having such a gas turbine casing arrangement; as well as a method for securing the guide-vane ring in the direction of through-flow axially at the gas turbine casing element of such a gas turbine casing arrangement.

A gas turbine having a gas turbine casing or housing element and a guide-vane ring with an outer ring is known from US 2007/0122270 A1. The outer ring is fastened to the housing element that engages radially in recesses in the outer ring by means of spokes fixed in place in the housing element. An ensheathed or coated ring, which lies radially opposite a rotor grid adjacent to the guide-vane ring, is fastened directly at the outer ring and is axially engaged therewith by axial projections in recesses in the outer ring.

In an operating position, gas turbine casing element, guide-vane ring, and coated ring have different heat expansions. Due to the direct axial support between outer ring and coated ring with the normal high forces associated therewith, the thermally caused radial relative movements bring about high wear.

BRIEF SUMMARY OF THE INVENTION

An object of one embodiment of the present invention is to provide an improved gas turbine.

This object is achieved by a gas turbine casing arrangement having the features of the present invention. The present invention provides for a gas turbine, in particular a gas turbine for an aircraft engine having such a gas turbine casing arrangement, as well as a method for securing the guide-vane ring in the direction of through-flow axially at the gas turbine casing element of such a gas turbine casing arrangement. Advantageous embodiments of the invention are set forth in detail below.

According to one aspect of the present invention, a gas turbine casing arrangement has a casing with one or more gas turbine casing elements, a guide-vane ring, which in one embodiment has a plurality of guide vanes defining a guide-vane grid and an outer ring, as well as an ensheathed or coated ring, which lies radially opposite a rotor grid that has a plurality of rotating blades and that is adjacent to the guide-vane ring or the guide-vane grid thereof, in particular following it in the direction of through-flow.

In one embodiment, the guide-vane ring, in particular, the guide-vane grid thereof and the outer ring are integrally formed. In one embodiment, the coated ring is segmented or has a plurality of adjacent segments in the peripheral direction. In one embodiment, the coated ring has a seal, in particular a honeycomb seal, which surrounds the rotor grid radially outside. In one embodiment, the coated ring is secured, in particular fixed in a stationary manner, at the gas turbine casing element axially in the direction and/or opposite to the direction of through-flow and/or radially and/or in the peripheral direction. In particular, it can be fastened to a preferably downstream axial region directly, i.e., without intermediate element, or indirectly, i.e., via one or more intermediate elements, joined with the gas turbine casing element, in particular, in a detachable manner or in a stationary manner.

According to one aspect of the present invention, the gas turbine casing arrangement has an intermediate ring, which engages behind an upstream stop fixed in place on the casing element by a downstream front face, and engages behind a downstream stop fixed in place on the outer ring by an upstream front face of a radial flange of the intermediate ring, in order to secure the guide-vane ring axially at the gas turbine casing element in the direction of through-flow, or which secures the guide-vane ring axially at the gas turbine casing element in the direction of through-flow.

In one embodiment, a gap is formed between the radial flange and the coated ring in an installed position, in order to make possible a movement of the radial flange radially outward or which makes possible a radially outward movement of the radial flange. In this way, in one embodiment, additionally, an axial movement of the radial flange and/or a movement of the radial flange in the peripheral direction and/or a tilting movement of the radial flange can also be made possible or is made possible. A movement of the radial flange radially outward, in particular, can comprise, and particularly comprises, an expansion of the radial flange in the radial direction.

In one embodiment, by means of interpositioning an intermediate ring, which secures the guide-vane ring axially at the gas turbine casing element in the direction of through-flow, in particular, if, in an enhancement, the radial flange has a gap relative to the coated ring in the installed position, so that it can move radially outward due to thermal inducement in an operating position, the guide-vane ring and the coated ring are subject to different heat expansions, advantageously reducing wear as a consequence of a relative movement under high normal force.

An upstream front face or an upstream stop in the sense of the present invention is a surface, whose outward normal line is directed opposite to the direction of through-flow of an exhaust gas flowing through the gas turbine or encloses with the latter an angle greater than 90°, particularly, at least essentially, equal to 180°, i.e., in other words, faces an inlet of the gas turbine or faces away from the guide-vane grid. Correspondingly, a downstream front face or an upstream stop is understood to be a surface, whose outward normal line is in the same direction as the direction of through-flow, or encloses with the latter an angle of less than 90°, particularly, at least essentially, equal to 0°, i.e., in other words, faces an outlet of the gas turbine or the guide-vane grid.

Correspondingly, the outer ring of the guide-vane ring, which is loaded or stressed axially in the direction of through-flow due to the through-flow, is supported axially in the direction of through-flow by its downstream stop at the upstream front face of the radial flange of the intermediate ring, which in turn is supported axially by its downstream front face in the direction of through-flow at the upstream stop fixed in place on the casing element.

An installed position is, in particular, a non-operating state of the standing, unfired gas turbine, the latter particularly having normal or ambient temperature, particularly at least 10° C. and/or at most 50° C. In one embodiment, the intermediate ring in the installed position essentially has overall the same temperature, in particular, normal or ambient temperature, which preferably also applies to the guide-vane ring, the turbine casing element, and/or the coated ring.

Correspondingly, an operating position is particularly an operating state of the operating, i.e., fired and rotating, gas turbine, particularly a design condition, preferably at a point of aircraft operation during take-off, landing, or in-flight, whereby in one embodiment of the guide-vane ring, the turbine casing element, the coated ring, and/or the force ring have a temperature of at least 100° C., in particular at least 150° C. In the operating position, the intermediate ring may have a temperature gradient, in particular between its downstream front face allocated to the casing and its upstream front face allocated to the outer ring of the guide-vane ring. In particular, if the operating position involves a take-off operating point or the like, the temperature of the gas turbine casing element—and thus also the downstream front face of the intermediate ring—can be significantly higher, in particular, by at least 50° C., than the temperature of the outer ring of the guide-vane ring—and thus also of the upstream front face of the intermediate ring.

In one embodiment, the gap between the radial flange and the coated ring is a radial and/or an axial gap, which makes possible a thermally induced movement of the radial flange radially outward from the installed position, without the coated ring impeding this movement. In one embodiment, this gap or axial and/or radial, particularly shortest, distance between radial flange and coated ring amounts to at least 0.5 mm, in particular, at least 1 mm, in particular at least 5 mm. Additionally or alternatively, in one embodiment, this gap amounts to 50 mm at most, in particular 25 mm at most, in particular 10 mm at most.

After the radial flange has expanded radially as a consequence of heating caused by operation, it may contact the coated ring. Correspondingly, in one embodiment, the radial flange abuts the coated ring (at the latest) in an operating position and, in an enhancement, is supported axially and/or radially at the latter in a form fit and/or friction fit. Advantageously, the initial gap or the gap (still) present in the installed position between the intermediate ring and the coated ring can be sealed thereby, brought about by operation, and thus reduces an undesired leakage, in particular, prevents it. In particular, for implementing the aspect of supporting the coated ring on the intermediate ring, which is explained in detail below, in order to be radially expanded by the latter, the coated ring can contact the radial flange even as early as in the installed position, preferably from radially outside.

In an enhancement, the radial flange abuts the coated ring on the surface (at the latest) in an operating position. For this purpose, in one embodiment, a contact surface of the radial flange can be formed for contacting the coated ring in such a way that in the operating position, it is at least essentially parallel to a contact surface of the coated ring, for contacting the radial flange. In other words, the angle at which the radial flange inclines for the radial expansion is maintained in the installed position. In one embodiment, an axial flange of the intermediate ring, at which its radial flange is disposed, has a crease or line for this purpose.

In one embodiment, the radial flange abuts, (at the latest) in the operating position, and particularly the surface of a support wall of the coated ring, which is disposed at its seal that surrounds the rotor grid radially outside. A direct support at the seal can be avoided thereby, so that its functionality advantageously is not influenced by the intermediate ring being supported.

In one embodiment, the radial flange forms an outer wall structure of a flow channel, in which the rotor grid is disposed. In operation, the radial flange is stressed and heated thereby by the hot exhaust flowing through the flow channel and the rotor grid, which brings about or reinforces the radial expansion that is thermally induced, as was explained above.

In one embodiment, the intermediate ring has an axial flange, which is disposed between its downstream front face and its upstream front face, and on which the radial flange of the intermediate ring is disposed. As explained above, the latter may have a crease or line in a meridian section.

In one embodiment, the axial flange is or will be elastically deformed in the operating position. For this purpose, the axial flange can be elastically formed correspondingly, in particular by suitable selection of material and/or geometry. As explained above, by means of this elastic deformation, the radial flange may expand radially due to heat during operation.

Additionally or alternatively to such elastic deformation, in one embodiment, the downstream front face can be disposed at another radial flange of the intermediate ring, which is articulated tiltably at the gas turbine casing element. In particular, it is presently understood by this that the additional radial flange of the intermediate ring is supported rotatably in a meridian section at the stop fixed in place on the casing element. For this purpose, the additional radial flange of the intermediate ring may have on its side lying opposite to the downstream front face of the intermediate ring or to the upstream stop fixed in place on the casing element, a rounding and/or an axial play relative to the gas turbine casing element, which, in the meridian section, makes possible or permits a rotation of the cross section of the additional radial flange supported at the stop fixed in place on the casing element.

In other words, a cross section of the intermediate ring rotates in a meridian section in the case of a radial expansion of its radial flange.

In particular, for this purpose, in one embodiment, in the installed position and/or operating position, a contact surface is disposed between the upstream front face of the radial flange of the intermediate ring and the downstream stop fixed in place on the outer ring axially downstream in the direction of through-flow, and/or radially inside from a contact surface between the downstream front face of the intermediate ring and the upstream stop fixed in place on the casing element, in order to thus impart a corresponding torque for tilting the additional radial flange of the intermediate ring.

In one embodiment, the outer ring is or will be fastened at the gas turbine casing element by one or more radial spokes, in particular with radial play in the installed position. In particular, a form fit between radially inward extending projections fixed in place on the casing element and radially outward extending projections fixed in place on the outer ring is understood here, projections that secure, particularly fix in place, the outer ring at the gas turbine casing element at least in the peripheral direction. Advantageously, a heat expansion of the guide-vane ring can be taken into account by means of such a spoke suspension.

In particular, if the guide-vane ring is a guide-vane ring of an internal stage, or at least one additional, downstream guide-vane ring is disposed in the gas turbine casing element, in one embodiment, the upstream stop fixed in place on the casing element is disposed at a securing ring, which is fastened in detachable manner, in particular by form fit or friction fit, or in non-detachable manner, in particular cohesively, in the gas turbine casing element. In one embodiment, the assembly can be simplified thereby, in particular by moving the intermediate ring, particularly its additional radial flange, into a corresponding groove in the gas turbine casing element, and subsequently securing it axially by the securing ring in the direction of through-flow.

In another embodiment, the upstream stop fixed in place to the casing element is disposed in a peripheral groove of a bayonet hook. In one embodiment, the assembly can also be simplified thereby, in particular by rotating the intermediate ring, particularly its additional radial flange, in the peripheral groove of the bayonet hook in the peripheral direction, and thus engaging it behind the stop fixed in place on the casing element defined by this peripheral groove.

The two above-named arrangements of the upstream stop fixed in place on the casing element are thus also possible, if the guide-vane ring is a last or downstream guide-vane ring of the casing element; in other words, is disposed at a module interface, particularly between a so-called turbine mid-frame and a (low-pressure) turbine. In particular, in such a case, the upstream stop fixed in place on the casing element can also alternatively be disposed at an additional gas turbine casing element combined with the first gas turbine casing element in a detachable manner, particularly by form fit and/or friction fit, or in a non-detachable manner, in particular cohesively; thus the gas turbine casing element can particularly be part of a turbine mid-frame and the additional gas turbine casing element can be part of a casing of a (low-pressure) turbine. In one embodiment, the assembly can also be simplified thereby, particularly by axially securing or having secured the intermediate ring, particularly its additional radial flange, between the gas turbine casing element and the additional gas turbine casing element.

In an enhancement, the securing ring discussed above is supported radially at the coated ring, at least in the operating position. The coated ring can take on another functionality thereby.

According to one aspect of the present invention, the coated ring is radially supported, particularly from radially outside, at the intermediate ring. The intermediate ring can take on another functionality thereby.

Additionally or alternatively, a radial expansion of the intermediate ring, in particular a tilting of its additional radial flange with corresponding tilting of a cross section of the axial flange, also can bring about an advantageous radial adjustment of the coated ring being supported on it: that is, if the intermediate ring, in particular its radial flange, is expanded radially outward, then the coated ring lying on it radially from outside also will be guided radially outward thereby. In this way, a radial gap between the coated ring, in particular of a seal fixed in place on the coated ring, and the rotor grid lying radially opposite can be optimized. Thus, in particular, the rubbing of the rotor grid into the seal can be reduced during the start-up or take-off phase. In one embodiment, the coated ring is supported radially at the intermediate ring in such a way that a radial distance between the coated ring and the rotor grid or its outer circumference remains the same, at least substantially, in the installed and operating positions.

In an enhancement, the coated ring is supported radially at the intermediate ring by an axial region, which is particularly upstream, from radially outside, and is preferably joined to the gas turbine casing element by another axial region, which is particularly downstream, in particular, joined to it in a detachable manner or permanently, either directly, i.e., without intermediate element, or indirectly, i.e., via one or more intermediate elements.

In this way, with a radial expansion of the intermediate ring, in particular its radial flange, the intermediate ring can lead or expand radially outward the first axial region of the coated ring, particularly an upstream axial region, relative to the additional axial region of the coated ring, which is fixed in place on the casing, particularly a downstream axial region, and thus can automatically optimize a radial gap relative to the rotor grid.

Correspondingly, in an enhancement, particularly at least in the installed position, the first axial region of the coated ring, particularly the upstream axial region, which is radially supported at the intermediate ring from radially outside, preferably also a seal of the coated ring, this seal surrounding the rotor grid radially outside, has radially outward play or free space, particularly a radial gap relative to the gas turbine casing element or an element joined thereto, which lies radially outside opposite to it. In one embodiment, correspondingly, the coated ring is supported radially at the intermediate ring from radially outside by a radially outward, particularly elastic, movable axial region, in particular an upstream axial region, and is preferably joined to the gas turbine casing element by another axial region, which is particularly downstream.

In one embodiment, the axial region of the coated ring, in particular the upstream axial region, is supported from radially outside on the axial flange of the intermediate ring. As stated above, a radial expansion of the coated ring can be or is adjusted or given in advance by corresponding selection of the support geometry, taking into consideration the deformations that are thermally caused in particular, and that occur during operation.

In one embodiment, a gas passage from a surface of the intermediate ring facing the guide-vane ring to a surface of the intermediate ring laying opposite the latter is provided or formed, particularly by a leakage between the downstream front side and the upstream stop or corresponding passages at the axial flange and/or the additional radial flange. In this way, in an enhancement, advantageously, cooling air that is present on the surface of the intermediate ring facing the guide-vane ring can flow through the gas passages into the space separated by the intermediate ring and can act therein advantageously as sealing air, in particular in a cavity above the coated ring.

According to an aspect of the present invention, for securing the guide-vane ring axially at the gas turbine casing element in the direction of through-flow, the intermediate ring, in the installed position, is disposed at the guide-vane ring and the gas turbine casing element in such a way that a gap is formed between the radial flange of the guide-vane ring and the coated ring, in order to make possible a movement of the radial flange radially outward.

BRIEF DESCRIPTION OF THE DRAWINGS

Additional advantageous enhancements of the present invention is further discussed in the following description of preferred embodiments. For this purpose and partially schematized.

DETAILED DESCRIPTION OF THE INVENTION

Figure 1:
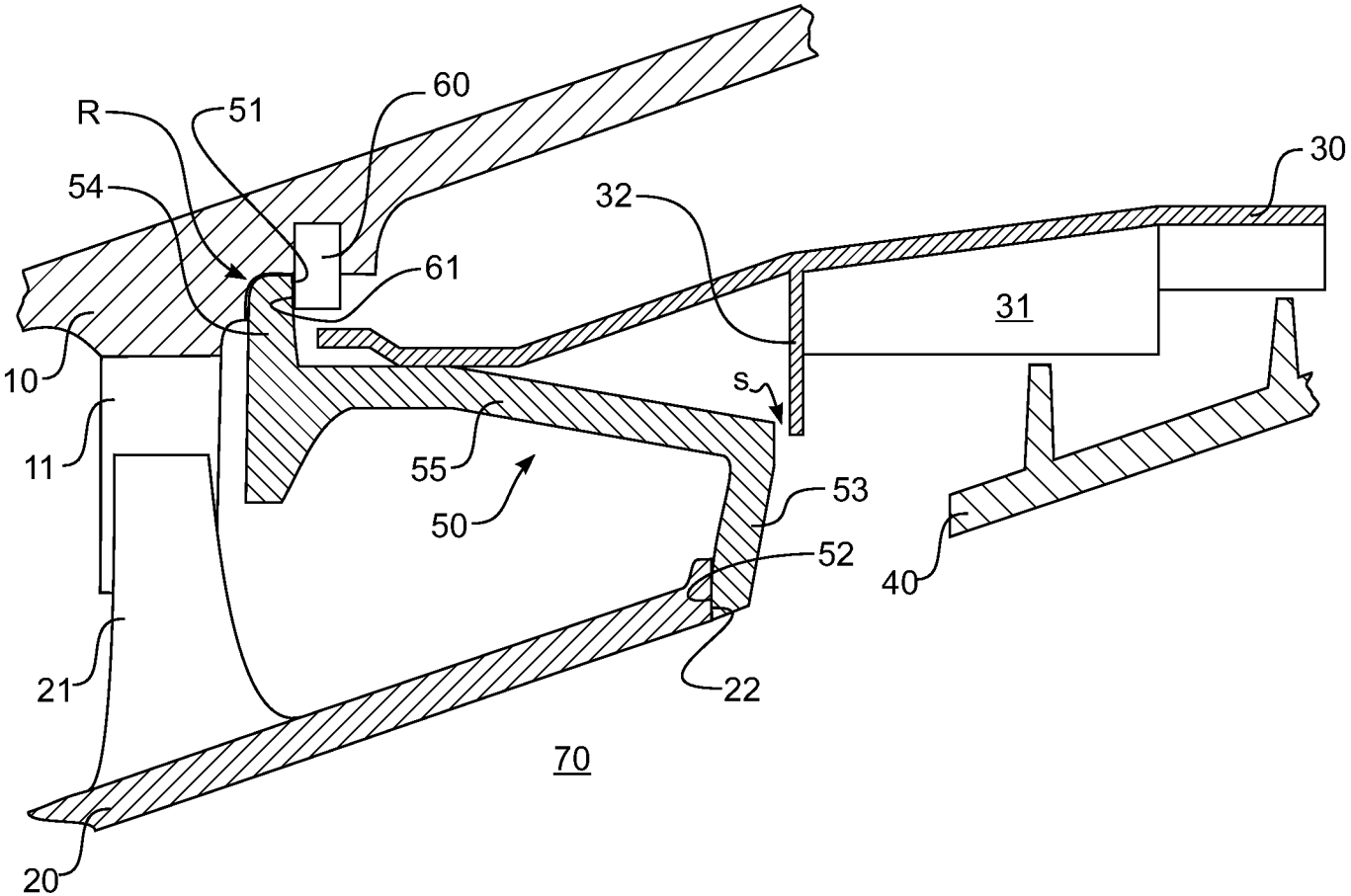
FIG. 1 shows a gas turbine casing arrangement of a gas turbine according to an embodiment of the present invention in a meridian section in an installed position.

FIG. 1 shows a gas turbine casing arrangement according to an embodiment of the present invention in a meridian section, i.e., a section that contains an axis of rotation of the gas turbine (horizontal in FIG. 1), in an installed position.

The gas turbine casing arrangement in FIG. 1 has a gas turbine casing element 10, which is only partially shown, a guide-vane ring with an outer ring 20, as well as a coated ring 30, which lies radially opposite (from bottom to top in FIG. 1) a rotor grid successively adjacent to the guide-vane ring in the direction of through-flow (from left to right in FIG. 1), the rotor grid having an outer shroud 40. The coated ring 30 has a honeycomb seal 31 surrounding the rotor grid radially outside.

In addition, the gas turbine casing arrangement has an intermediate ring 50, which engages behind an upstream stop 61 fixed in place on the casing by a downstream front face 51 and a downstream stop 22 fixed in place on the outer ring by an upstream front face 52 of a radial flange 53 of the intermediate ring 50, in order to secure the guide-vane ring axially at the gas turbine casing element in the direction of through-flow (from left to right), whereby, in the installed position shown in FIG. 1, a gap s is formed between the radial flange 53 and the coated ring 30, in order to make possible a radially outward movement of the radial flange 53 (toward the top in FIG. 1).

Figure 2:
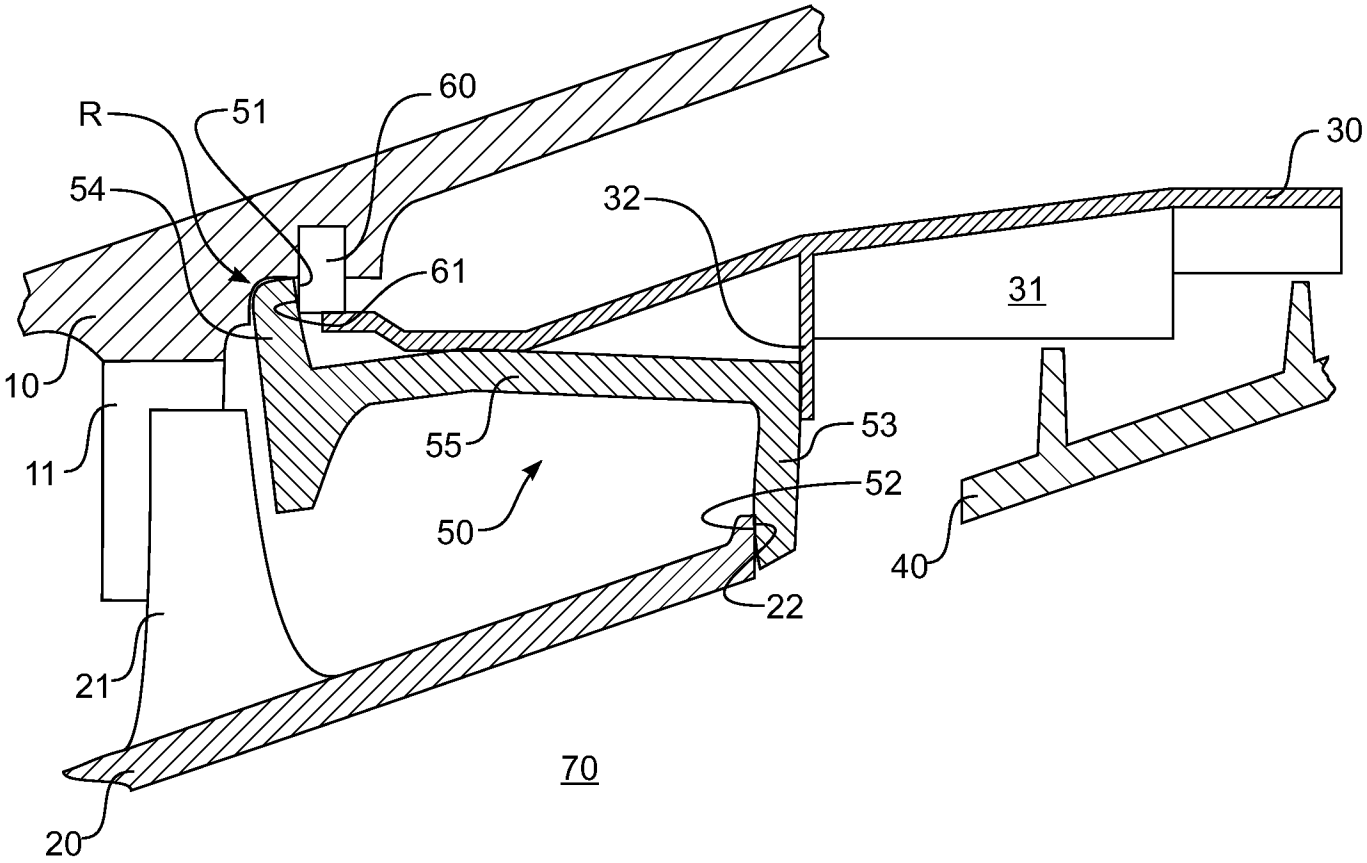
FIG. 2 shows the gas turbine casing arrangement of FIG. 1 in an operating position.

FIG. 2 shows the gas turbine casing arrangement of FIG. 1 in an operating position: after the radial flange 53 has expanded radially as a consequence of heating brought about by operation, in the operating position, it abuts the surface of a support wall 32 of the coated ring 30, which is disposed at its seal 31 surrounding the rotor grid radially outside, and is supported at this support wall 32. In the overview of FIGS. 1, 2, one also recognizes the radial and axial displacement of the outer ring 20 as a consequence of thermal stress and mechanical stress related to flow.

The radial flange 53 forms an outer wall structure of a flow channel 70, in which the rotor grid is disposed. In this way, during operation, the radial flange is loaded or stressed by the hot exhaust gas flowing through the flow channel 70 and the rotor grid.

The intermediate ring 50 has an axial flange 55, which is disposed between its downstream and its upstream front surfaces 51, 52, and at which the radial flange 53 of the intermediate ring is disposed. In the meridian section of FIG. 1, the latter has a crease or line in order to maintain the angle at which the radial flange 53 inclines upon radial expansion.

The downstream front face 51 is disposed at another radial flange 54 of the intermediate ring 50, which is articulated tiltable at the gas turbine casing element 10. As is shown by the overview of FIGS. 1 and 2, the additional radial flange 54 of the intermediate ring rotates around a contact point at the stop 61 fixed in place on the casing element and is supported rotatable thereto at the stop, in the meridian section of FIGS. 1, 2. For this, the additional radial flange 54 of the intermediate ring has, on its side lying opposite the downstream front face 51 of the intermediate ring or opposite the upstream stop 61 fixed in place on the casing element (i.e., on the left in FIG. 1), a rounding and/or an axial play relative to the gas turbine casing element 10, which, in the meridian section, makes possible or permits a rotation of the cross section of the additional radial flange 54 supported at the stop 61 fixed in place on the casing element.

In the installed position (see FIG. 1) and in the operating position (see FIG. 2), a contact surface is disposed between the upstream front face 52 of the radial flange 53 of the intermediate ring and the downstream stop 22 fixed in place on the outer ring in the direction of through-flow axially downstream and radially inside, i.e., on the right and bottom in FIG. 1, from a contact surface between the downstream front face 51 of the intermediate ring and the upstream stop 61 fixed in place on the casing element, in order to thus impart a corresponding torque for tilting the additional radial flange of the intermediate ring.

The outer ring 20 is fastened at the gas turbine casing element 10 by a plurality of radial spokes 11, 21 with radial play between the radially inward extending projections 11 fixed in place on the casing element and the radially outward extending projections 21 fixed in place on the outer ring, in the installed position, the projections securing the outer ring 20 at the gas turbine casing element 10 in the peripheral direction.

In the embodiment of FIGS. 1, 2, the guide-vane ring is a guide-vane ring of an internal stage. Therefore, the upstream stop 61 fixed in place on the casing element is disposed at a securing ring 60, which is fastened by friction fit in the gas turbine casing element 10. In a modification (not shown), the upstream stop fixed in place on the casing element is instead disposed in a peripheral groove of a bayonet hook. For this purpose, in FIG. 1, the securing ring 60 is thought of as formed integrally with the gas turbine casing element 10, whereby the additional radial flange 54 and the securing ring 60 then have corresponding gaps in the peripheral direction (perpendicular to the plane of the drawing of FIG. 1), so that the additional radial flange can be shifted first axially counter to the direction of through-flow and then can be rotated in the peripheral direction, so that its front face 51 then engages behind the stop 61.

The discussed securing ring 60 is supported radially at the coated ring 30 in the operating position (see FIG. 2). The coated ring 30 in its turn is supported radially at the intermediate ring 50 both in the installed position and in the operating position from radially outside (from the top in FIG. 1) by an upstream (on the left in FIGS. 1, 2) axial region. Its opposite-lying, downstream axial region, which is not shown in FIGS. 1, 2, is joined directly or indirectly with the gas turbine casing element.

The upstream axial region of the coated ring, which is supported radially at the intermediate ring from radially outside, has play or free space, radially outward (toward the top in FIGS. 1, 2) in particular a radial gap relative to the gas turbine casing element 10.

As shown in the overview of FIGS. 1, 2, upon a radial expansion of its radial flange 53 as a consequence of the support of the upstream axial region of the coated ring 30, the intermediate ring 50 guides the latter radially outward with it. In this way, in particular, a radial gap can be kept constant, at least substantially, relative to the rotor grid 40 expanding thermally radially outward or relative to the fins on its outer shroud.

Figure 3:
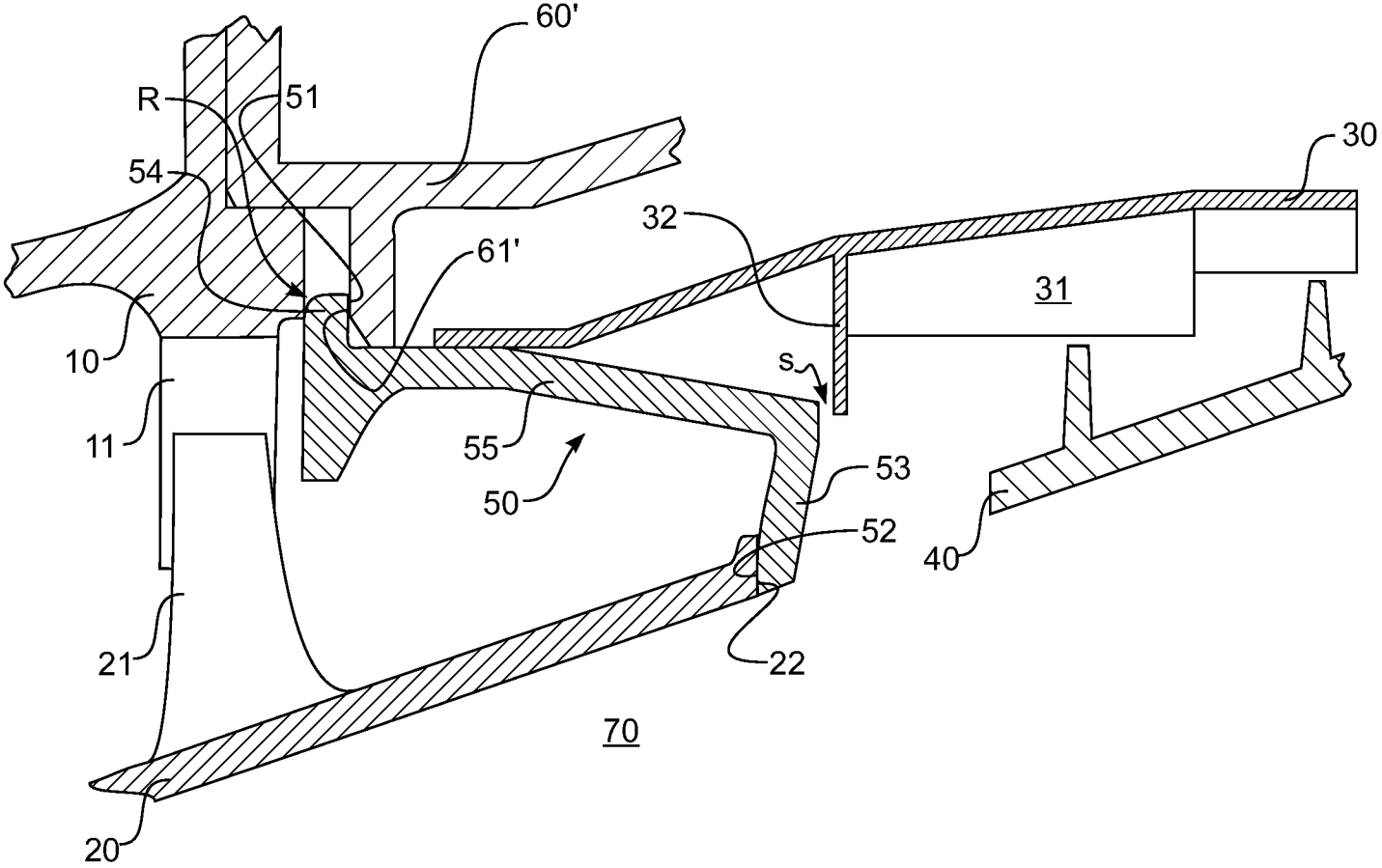
FIG. 3 shows a gas turbine casing arrangement of a gas turbine according to another embodiment of the present invention in a representation corresponding to FIG. 1.

FIG. 3 shows a gas turbine casing arrangement of a gas turbine according to another embodiment of the present invention in a representation corresponding to FIG. 1. Features corresponding to each other are identified by identical reference numbers, so that reference is made to the preceding description, and only differences will be discussed in the following.

In the embodiment of FIG. 3, the guide-vane ring is the last or a downstream guide-vane ring of the casing element and is disposed at a modular interface between a turbine mid-frame and a low-pressure turbine. The upstream stop 61' fixed in place on the casing element is disposed in this case at another gas turbine casing element 60' that is part of a casing of the low-pressure turbine, and which is joined to the gas turbine casing element 10 that is part of a turbine mid-frame.

Although exemplary embodiments were explained in the preceding description, it shall be noted that a plurality of modifications is possible. In addition, it shall be noted that the exemplary embodiments only involve examples that in no way shall limit the scope of protection, the applications and the structure. Rather, a guide is given to the person skilled in the art by the preceding description for implementing at least one exemplary embodiment, whereby diverse changes, particularly with respect to the function and arrangement of the described components, can be carried out without departing from the scope of protection, as results from the claims and combinations of features equivalent to these.

The invention claimed is:

1. A gas turbine casing arrangement, comprising:

a gas turbine casing element;

a guide-vane ring with an outer ring; and a coated ring, which lies radially opposite a rotor grid adjacent to the guide-vane ring; wherein an intermediate ring, which, by a downstream front face engages behind an upstream stop fixed in place on the casing element, and by an upstream front face of a radial flange of the intermediate ring engages behind a downstream stop fixed in place on the outer ring, in order to axially secure the guide-vane ring at the gas turbine casing element in the direction of through-flow;

wherein in an operating position, a surface area of the radial flange abuts the coated ring at a support wall disposed at a seal.

2. The gas turbine casing arrangement according to claim 1, wherein, in an installed position, a gap(s) is formed between the radial flange and the coated ring (30), in order to make possible a radially outward movement of the radial flange.

3. The gas turbine casing arrangement according to claim 1, wherein the radial flange forms an outer wall structure of a flow channel, in which the rotor grid is disposed.

4. The gas turbine casing arrangement according to claim 1, wherein the intermediate ring has an axial flange, which is disposed between its downstream and its upstream front faces, and is elastically deformed in an operating position.

5. The gas turbine casing arrangement according to claim 1, wherein the downstream front face is disposed at another radial flange of the intermediate ring, which is articulated tiltable at the gas turbine casing element.

6. The gas turbine casing arrangement according to claim 1, wherein the outer ring is fastened at the gas turbine casing element by spokes with radial play in the installed position.

7. The gas turbine casing arrangement according to claim 1, wherein the upstream stop fixed in place on the casing element is disposed at a securing ring, which is fastened detachably or non-detachably in the gas turbine casing element; or in a peripheral groove of a bayonet hook; or is disposed at an additional gas turbine casing element joined detachably or non-detachably to the gas turbine casing element.

8. The gas turbine casing arrangement according to claim 7, wherein the securing ring is radially supported at the coated ring, at least in an operating position.

9. The gas turbine casing arrangement according to claim 1, wherein the coated ring is radially supported at the intermediate ring.

10. The gas turbine casing arrangement according to claim 9, wherein the coated ring is supported radially at the intermediate ring by an axial region, which is particularly upstream, and is joined to the gas turbine casing element by another axial region, which is particularly downstream.

11. The gas turbine casing arrangement according to claim 1, further comprising a gas passage from a surface of the intermediate ring facing the guide-vane ring to a surface of the intermediate ring lying opposite the latter.

12. The gas turbine casing arrangement according to claim 1, wherein the coated ring is segmented and/or the guide-vane ring is formed integrally.

13. The gas turbine casing arrangement according to claim 1, wherein at least one additional, downstream guide-vane ring is disposed in the gas turbine casing element, or in that the guide-vane ring is a most downstream guide-vane ring in the gas turbine casing element.

14. The gas turbine casing arrangement of claim 1, wherein the guide-vane ring is secured in the direction of through-flow axially at the gas turbine casing element of the gas turbine casing arrangement where the intermediate ring, by its downstream front face, engages behind the upstream stop fixed in place on the casing element, and by its upstream front face of its radial flange engages behind the downstream stop fixed in place on the outer ring.

* * * * *